United States Patent [19]

Philipp et al.

[11] Patent Number: 4,883,211

[45] Date of Patent: Nov. 28, 1989

[54] EXPLOSIVE POWDER CHARGE OPERATED FASTENING ELEMENT SETTING DEVICE

[75] Inventors: Leo Philipp, Untervaz, Switzerland; Ernst Thuer; Gerhard Ehmig, both of Rankweil, Austria

[73] Assignee: Hilti Aktiengesellschaft

[21] Appl. No.: 319,425

[22] Filed: Mar. 3, 1989

[30] Foreign Application Priority Data

Mar. 3, 1988 [DE] Fed. Rep. of Germany ..... 3806831

[51] Int. Cl.[4] ..... B25C 1/14; B25D 17/24

[52] U.S. Cl. ..... 227/9; 173/162.2

[58] Field of Search ..... 227/9, 10; 173/139, 173/162.1, 162.2; 408/143; 188/378, 379

[56] References Cited

U.S. PATENT DOCUMENTS 2,488,992 11/1949 Taylor ..... 173/162.1 X 3,469,504 9/1969 Neighorn ..... 227/10 X 4,776,408 10/1988 Elkin et al. ..... 173/162.1 X

*Primary Examiner*—Donald R. Schran

*Assistant Examiner*—James L. Wolfe

*Attorney, Agent, or Firm*—Toren, McGeady & Associates

[57] ABSTRACT

An explosive powder charge operated fastening element setting device includes a housing supporting a handle. A damping unit is arranged between the handle and the housing so that the handle is displaceable in the setting direction of the setting device against a force developed in the damping device. A fastening element guide is mounted in the housing for movement opposite to the setting direction against a spring force. The force of the damping unit is greater than the spring force. The damping unit includes a cylinder containing a first fluid medium acting on a piston pressing, outside the cylinder, against the housing with a second fluid medium within the cylinder pressurizing the first fluid medium.

5 Claims, 2 Drawing Sheets

EXPLOSIVE POWDER CHARGE OPERATED FASTENING ELEMENT SETTING DEVICE

BACKGROUND OF THE INVENTION

The present invention is directed to an explosive powder charge operated fastening element setting device with one part of the device forming a housing, another part forming a handle with the handle being displaceable with respect to the housing against the force of a damping unit. In addition, a fastening element guide is mounted in the housing for movement opposite to the setting direction of the setting device against the biasing action of a spring force.

An explosive powder charge operated setting device is disclosed in U.S. Pat. No. 2,731,636, and includes a housing with a fastening element guide displaceable relative to the housing opposite to the setting direction and against the force of a spring. An additional spring is positioned between a part of the device acting as a handle and the housing and the spring serves for damping the recoil acting on the setting device operator when a fastening element is driven. Accordingly, the spring acts as a damping device, however, it has several shortcomings with regard to its operation.

In particular, the damping effect of a spring, as mentioned above, is adequate only at a low spring rate. A low spring rate requires a large space requirement, so that a device equipped with such a damping unit is unwieldy. The utilization of a higher spring rate reduces the damping effect, so that a high proportion of the undesirable recoil forces continue to act on the operator. Moreover, the restoring velocity of such a known spring is so high that concussive forces acting on the operator occur during the reset operation.

SUMMARY OF THE INVENTION

Therefore, the primary object of the present invention is to provide an explosive powder charge operated setting device including a damping unit affording considerable comfort to the operator while enabling an effective arrangement of the setting device.

In accordance with the present invention, the response force of the damping unit is greater than the force of the springs counteracting the movement of the fastening element guide by forming one part of the setting device as a receptacle for a cylinder containing a first fluid medium subjected to the pressure of a second fluid medium, with another part of the device forming a bearing surface for a piston in the damping unit with the piston being acted on by the first fluid medium.

As indicated, the fastening element setting device of the present invention includes a fastening element guide, displaceable with respect to the housing of the device counter to the force of a spring. The displaceability of the fastening element guide against the spring force is provided in particular for safety reasons, in that the fastening element setting device is only ready for ignition if, while pressing the fastening element setting device against a receiving material for the fastening elements, the fastening element guide is pressed into the housing at least partially enclosing the peripheral surface of the guide. It is only in the inwardly telescoped position of the fastening element guide that the ignition device is cocked so that the operation of the setting device can be actuated. Accordingly, it is important that the force of the spring acting on the fastening element guide along with the force of any additional springs serving for cocking the ignition device is overcome prior to the response of the damping unit. Only this arrangement assures that the damping unit is still able to absorb completely the recoil occurring during the setting step.

Due to the arrangement of one setting device part forming a receptacle for a cylinder containing a first fluid medium pressurized by a second fluid medium, and of another setting device part forming a support for a piston acted upon by the first fluid medium. With this arrangement, it is assured that a damping unit provides a sufficient, nearly constant damping force. Moreover, the arrangement of the damping unit affords the possibility of an effective construction of the fastening element setting device, whereby, in addition, the return velocity between the setting device parts is so low that no additional interfering concussive forces act o the operator.

Preferably, the receptacle for the cylinder in one part of the setting device has a trough-like form, while the support for the piston on another part of the setting device is in the form of a support bearing or surface. A simple exchange of the entire damping device is possible due to detachable connecting means coacting with the receptacle between the setting device parts and parts of the damping unit.

With regard to structural considerations, an effective and easily handled construction of the fastening element setting device can be obtained if, for instance, the trough-like part is located on the handle and the support bearing or surface is formed on a part of the housing. Such a design affords the possibility of a parallel arrangement of the damping unit with the ignition device in the rear region of the fastening element setting device.

The cooperation of the setting device part forming the housing with the other part forming the handle is effected by a piston comprising a part of the damping unit and coacting with a first fluid medium within the unit affording the advantage that the damping force, as well as the reset velocity, can be adapted to the existing conditions by the structural design of the piston. Such adaptability is provided by throttle apertures extending through the piston. The throttle apertures serve, in addition to a possibly existing clearance at the circumference of the piston, for displacement of the first fluid medium. To provide additional adaptability possibilities between the damping force and the reset velocity, which possibilities are turned to those two parameters, a valve may be provided for the throttle apertures so that the valve can close the throttle apertures during the reset operation, whereby the reset velocity can be adjusted.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
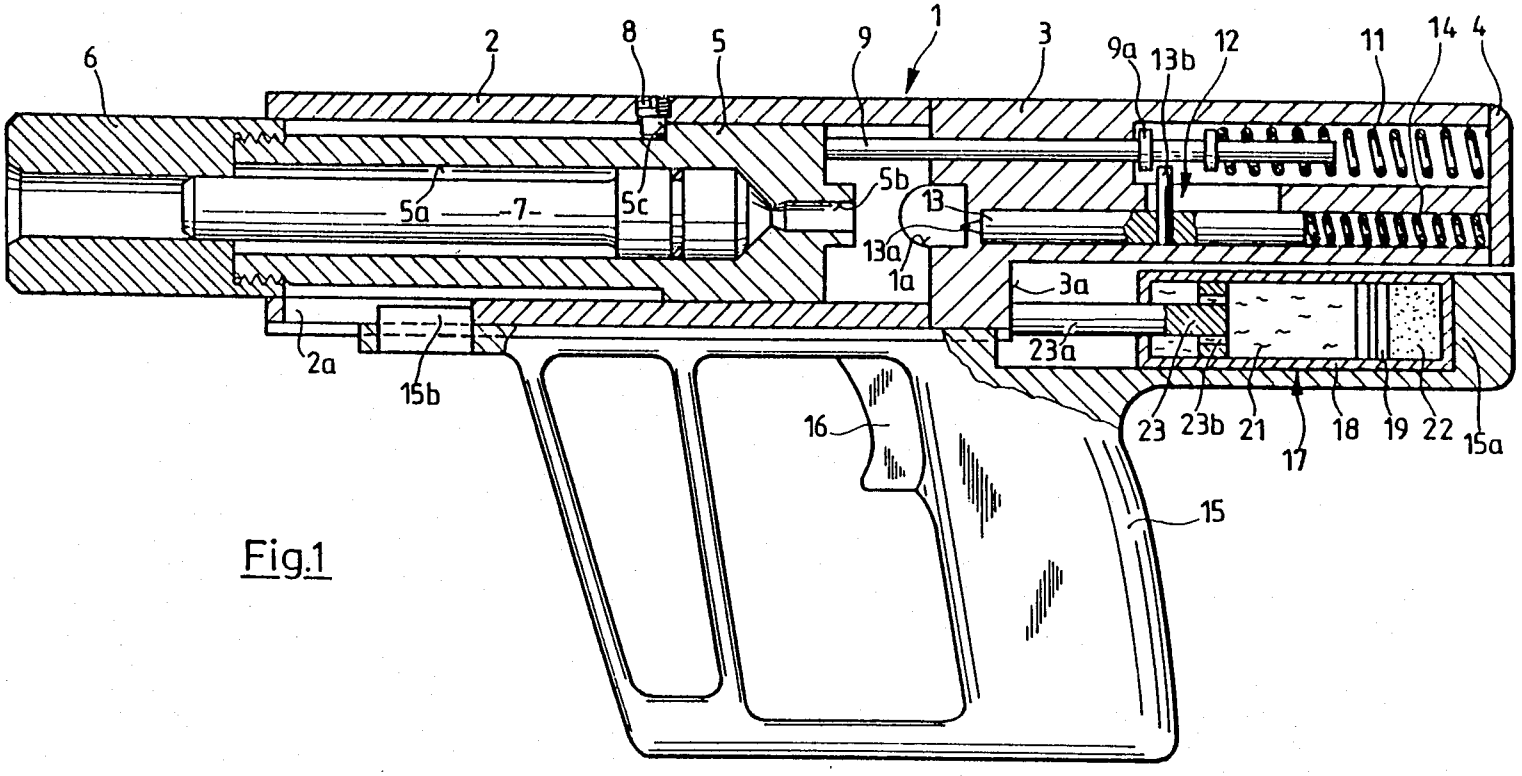
FIG. 1 is a side view, partly in section, of a fastening element setting device embodying the present invention and displayed in a neutral position.
Figure 2:
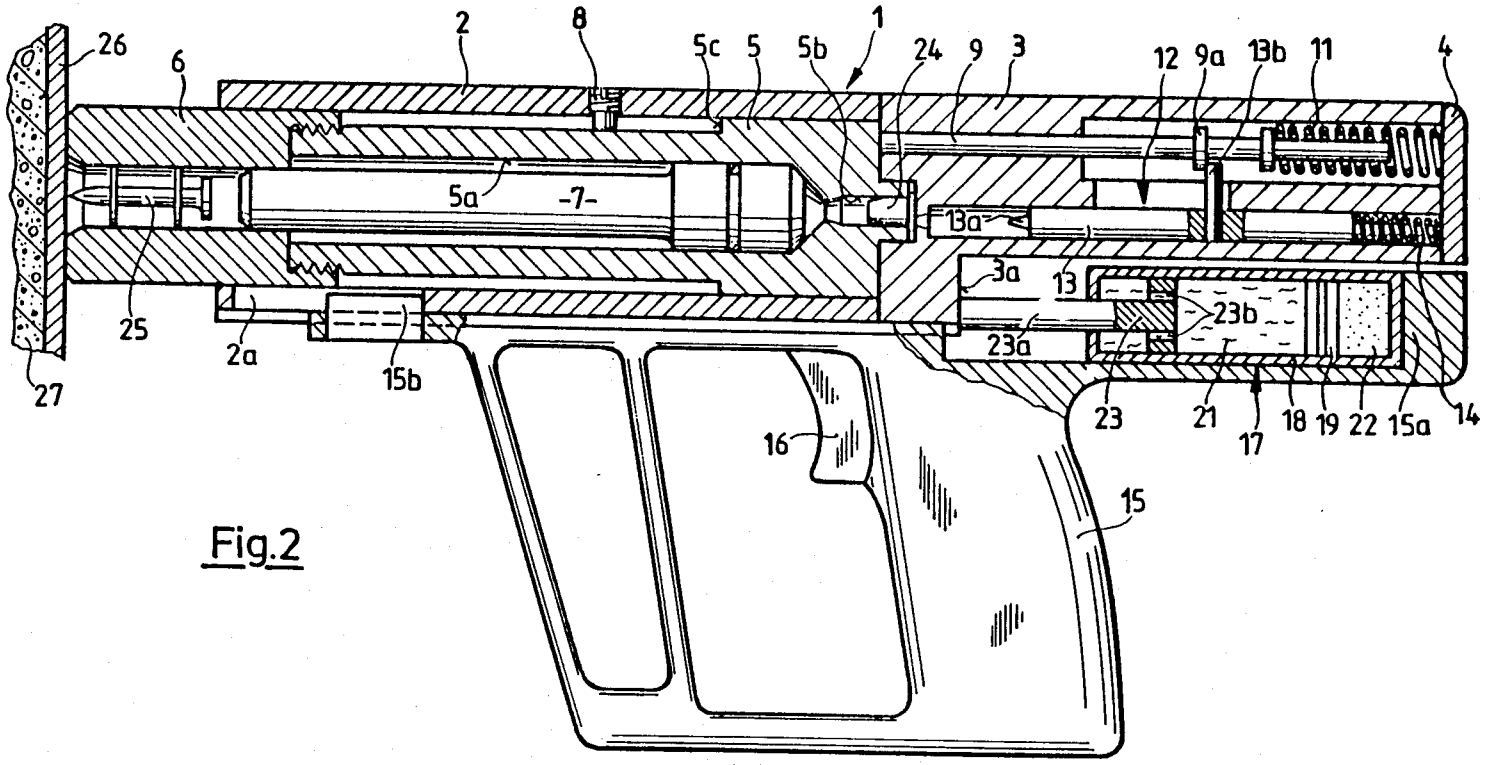
FIG. 2 is a view of the fastening element setting device similar to that in FIG. 1, however, with the device in th ready-to-fire condition.

In FIGS. 1 and 2, a fastening element setting device is displayed including a multipart housing 1 connected to form a single unit and made up of a front housing part 2, a rear housing part 3, and a cover 4, closing off the rear housing part 3. The setting device is arranged to drive fastening elements from the left-hand end of a barrel 5, as viewed in FIGS. 1 and 2. The axially extending barrel 5 is located within the housing part 2 and a muzzle part or fastening element guide 6 is positioned on the front end of the barrel and is displaceably supported in the front housing part 2. An axially extending drive piston 7 is slidably supported within the bore 5*a* of the barrel and the axially aligned bore through the guide 6. A cartridge chamber 5*b* is located in the rear end of the barrel and opens into the rear end of the barrel bore 5*a* for driving the piston 7 toward the front end of the setting device. A stop screw 8 extending through the housing part 2 extends inwardly to the path of the barrel 5 for limiting the displacement of the barrel 5 and the guide 6 in the leftward direction. Screw 8 coacts with a shoulder 5*c* on the barrel for effecting the stopping action. A tappet 9 is mounted in the rear housing part 3 and bears against the rear end of the barrel 5. The tappet 9 is pressed against the rear end of the barrel 5 by a spring 11.

A channel 1*a* extends through the housing 1 for feeding cartridges, held in a carrier strip, to the cartridge chamber 5*b*. An ignition device 12 is located in the rear housing part 3. The ignition device includes a firing pin 13, extending in the axial direction of the barrel 5, with a firing tip 13*a* on the end of the pin facing toward the rear end of the barrel. As viewed in FIG. 1, the firing tip 13*a* extends in the setting direction into the channel 1*a*. Intermediate the ends of the firing pin 13, an entrainment pin 13*b* extends transversely from the firing pin into the displacement path of an entrainment shoulder 9*a* mounted on the tappet 9 for the purpose of cocking the ignition device 12. An ignition spring 14, located rearwardly of the ignition pin 13, biases the pin in the setting direction. Both spring and spring 14 abut against the cover 4 at their rear ends.

A handle part 15 projects laterally and downwardly from the housing 1 and is displaceably supported on the housing for movement parallel to the barrel axis. A trigger 16 is located in the handle part 15 for actuating the setting device. A damping unit 17 is held between a support bearing or surface 3*a* in the rear housing part 3 and a trough-like receptacle 15*a* formed on the handle part 15. Damping unit 17 includes an elongated cylinder 18 with a separator piston 19 located in the rear region of the cylinder. The cylinder space in front of the separator piston 19 is filled with a first fluid medium, such as a liquid medium 21, preferably oil. On the opposite side of the separator piston, that is, between the separator piston and the rear end of the cylinder, there is a second fluid medium, in particular a pressurized gas cushion 22. The gas pressure is transmitted by the separator piston 19 to the liquid medium 21. Another piston 23 is located in the cylinder ahead of the separator piston 19 in the space containing the liquid medium 21. Piston 23 has an axially extending shaft 23*a* extending forwardly from the piston through the end of the cylinder and presses against the support surface 3*a* on the rear, housing part 3. The rear portion of the piston 23 widens in the manner of a head outwardly from the shaft 23*a* and is guided along the inner surface of the cylinder 18. Apertures 23*b* extend through the piston 23 and interconnect the spaces on the opposite sides of the piston.

The first fluid medium or liquid medium 21 is subjected to the pressure of the gas cushion 22 or second fluid medium and the liquid medium acts on all sides of the piston 23, located in the cylinder 18. The rear end face of piston 23 has a larger surface area than the opposite front end face, due to the presence of the shaft 23 at the front end face. This difference in area causes the movement of the piston 23 toward the front end of the housing into contact with the support surface 3*a*. As a result, the handle part 15 is maintained with respect to the housing 1 opposite the setting direction in the position shown, which is defined by the run-up of a stop part 15*b* on the handle part 15 against the end of an elongated aperture 2*a* in the front housing part 2. The ready-to-fire position shown in FIG. 2 is reached by pressing the fastening element setting device containing a cartridge 24 in the cartridge chamber 5*b* and a fastening element or nail 25 in the guide 6 against a part 26 to be secured by the fastening element to the receiving material 27. With the rearward displacement of the bolt guide and barrel, the tappet 9 is moved opposite to the setting direction against the force of spring 11. As the tappet moves rearwardly, it also moves the ignition pin 13 in the same direction by the interaction of the entrainment shoulder 9*a* with the entrainment pin 13*b*, and the ignition pin moves rearwardly against the force of spring 14. The spring force to be overcome to place the setting device in the ready-to-fire condition are smaller than the response force of the damping device 17, so that the forces can be transmitted from the housing part 15 to the housing 1 without the mutual displacement of these parts taking place.

The transmission of an interfering or even damaging recoil to the operator is prevented by the damping unit. Recoil forces of the barrel 5 are transmitted through the housing 1 to the piston 23. As a result, piston 23 is displaced rearwardly in the cylinder 18 with the throttle apertures 23*b* retarding the flow of the first fluid medium or liquid medium 21 from the cylinder space located behind the piston 23 into the space located ahead of the piston, whereby a damped displacement of the piston 23 takes place. Subsequently, piston 23 is again returned into its initial position as shown in FIG. 1 by the pressure of the second fluid medium or gas cushion 22 as described above, so that the liquid medium 21 flows again through the throttle apertures 23*b* from the space in front of the piston to the space behind the piston. After the fastening element setting device has been lifted off the receiving material 27, the spring 11 and the ignition spring 14 return the tappet and the ignition pin, respectively, into the neutral position as viewed in FIG. 1.

While specific embodiments of the invention have been shown and described in detail to illustrate the application of the inventive principles, it will be understood that the invention may be embodied otherwise without departing from such principles.

We claim:

1. Explosive powder charge operated setting device for driving fastening elements in a driving direction into a receiving material, comprising a housing having a front end and a rear end, a handle displaceably mounted on said housing, a damping unit in contact with said housing and said handle, a fastening element guide mounted in the front end of said housing and being displaceable into said housing counter to the driving direction against the force of spring mean biasing said guide in the setting direction, wherein the improvement comprises that said damping unit applies a force acting on said housing greater than the biasing force of said spring means, said handle is shaped as a receptacle for a cylinder forming a part of said damping unit and containing a first fluid medium pressurized by a second fluid medium, and said damping unit includes a first piston located within and extending out of said cylinder and bearing against said housing exteriorly of said cylinder with said first piston being acted on by said first fluid medium within said cylinder.

2. Explosive powder charge operated setting device, as set forth in claim 1, wherein said receptacle for said cylinder is formed as a trough-like part of said handle.

3. Explosive powder charge operated setting device, as set forth in claim 2, wherein said housing having a support surface with said first piston bearing against said support surface.

4. Explosive powder charge operated setting device, as set forth in claim 3, wherein said first piston has at least one throttle aperture extending therethrough so that said first fluid medium can flow between opposite sides of said first piston.

5. Explosive powder charge operated setting device, as set forth in claim 4, wherein a second piston is located within said cylinder between said first piston and the end of said cylinder more remote from the front end of said housing and separates said first fluid medium and second fluid medium.

* * * * *